US005692356A

United States Patent [19]

Baxter

[11] Patent Number: 5,692,356

[45] Date of Patent: Dec. 2, 1997

[54] INSULATED CONCRETE WALL TIE SYSTEM

[76] Inventor: Kenneth I. Baxter, 19475 200th, Big Rapids, Mich. 49307

[21] Appl. No.: 714,955

[22] Filed: Sep. 17, 1996

Related U.S. Application Data

[60] Division of Ser. No. 298,767, Aug. 31, 1994, Pat. No. 5,582,388, which is a continuation-in-part of Ser. No. 217, 260, Mar. 24, 1994, Pat. No. 5,409,193.

[51] Int. Cl.[6] ..... E04B 2/84; E04G 17/06

[52] U.S. Cl. ..... 52/309.11; 249/43; 249/45; 249/47; 249/91; 249/213; 249/216; 52/426; 52/435; 52/708; 52/714; 52/309.12

[58] Field of Search ..... 52/309.9–309.12, 52/421, 422, 424–426, 429, 432, 435, 440, 699, 707, 708, 714, 169.11; 249/43, 45, 46, 38, 91, 93, 190, 193, 196, 213, 216, 217, 219.1, 40, 47, 111, 215

[56] References Cited

U.S. PATENT DOCUMENTS

| | | | |
|---|---|---|---|
| 2,313,880 | 8/1943 | Leggett . | |
| 2,772,560 | 12/1956 | Neptune . | |
| 3,167,842 | 2/1965 | Pauli . | |
| 3,173,187 | 3/1965 | Pontiere . | |
| 3,994,471 | 11/1976 | Turolla . | |
| 4,193,573 | 3/1980 | Kinnucan . | |
| 4,234,156 | 11/1980 | Wepf . | |
| 4,239,173 | 12/1980 | Sawyer . | |
| 4,329,821 | 5/1982 | Long . | |
| 4,433,520 | 2/1984 | Maschhoff | 52/426 X |
| 4,889,310 | 12/1989 | Boeshart | 52/426 X |
| 4,924,641 | 5/1990 | Gibbar | 52/309.12 |
| 4,936,540 | 6/1990 | Boeshart . | |
| 4,967,528 | 11/1990 | Doran | 52/426 X |
| 5,107,648 | 4/1992 | Roby . | |
| 5,209,039 | 5/1993 | Boeshart . | |
| 5,240,344 | 8/1993 | Durand | 52/309.12 X |
| 5,323,578 | 6/1994 | Chagnon . | |
| 5,375,809 | 12/1994 | Goto . | |
| 5,390,459 | 2/1995 | Menses | 52/426 |
| 5,409,193 | 4/1995 | Baxter . | |
| 5,424,024 | 6/1995 | Bennett . | |
| 5,454,199 | 10/1995 | Blam et al. | 52/432 |
| 5,459,971 | 10/1995 | Sparkman | 52/426 |
| 5,488,806 | 2/1996 | Melnick et al. | 52/425 |

*Primary Examiner*—Robert Canfield
*Attorney, Agent, or Firm*—Price, Heneveld, Cooper, DeWitt and Litton

[57] ABSTRACT

Apparatus, method and product of in situ attachment of insulation panels to poured concrete walls as the walls are formed. Polymeric F-shaped strips are attached to novel tie bars by spring clip retainers, and receive the edges of insulation panels to hold them against the forms so that uncured concrete is poured between the forms and against the panels. After the concrete is cured, the forms are removed, leaving the spring clips and tie bars in the concrete, and resulting in a concrete wall having insulation panels and secured strips, the strips also serving to receive dry wall fasteners.

4 Claims, 4 Drawing Sheets

INSULATED CONCRETE WALL TIE SYSTEM

RELATED APPLICATION

This is a divisional of application(s) Ser. No. 08/298,767 now U.S. Pat. No. 5,582,388 filed on Aug. 31, 1994 which is a continuation-in-part of application Ser. No. 08/217,260, now U.S. Pat. No. 5,409,193, filed Mar. 24, 1994, and entitled INSULATED CONCRETE WALL TIE SYSTEM.

BACKGROUND OF THE INVENTION

This invention relates to poured concrete walls, and particularly to apparatus and a method for forming insulated poured concrete walls.

The forming of foundation/basement walls of poured concrete is conventional. To form a poured wall, forms are secured together astraddle a space which is later filled with uncured concrete. The concrete is then left to solidify and cure, the forms are removed, and the notched protruding ends of the metal ties which were used to secure the forms together are knocked off as with a hammer. If these ends of the ties are not removed, thermal conductivity thereof causes excess heat transfer with resultant increased energy usage. Even with the tie ends removed, the concrete walls conduct sufficient heat to cause considerable extra energy use.

Therefore, thermal insulation is sometimes applied to the cured concrete walls as by spraying it on, or a layer of insulation may be glued to the inside and/or outside wall surfaces. These insulation application processes, however, involve considerable added time and labor, so that normally the walls remain uninsulated. Yet, application of thermal insulation is particularly advantageous for decreasing energy costs. Indeed, in some jurisdictions the R value must meet certain minimum requirements.

SUMMARY OF THE INVENTION

An object of this invention is to provide a novel apparatus and method for applying thermal insulation to one or both poured concrete walls at the time the walls are poured. One or two insulation panels of selected thickness are specially retained in proper position on the inside walls of the forms so as to be on the inside and/or outside surfaces of the poured wall. Then the concrete is injected, e.g., poured into the forms and against the insulation, cured, and the forms later removed. The result is that the wall is already insulated to the extent desired, i.e., subsequent insulation application steps are not necessary. The apparatus employed includes novel tie bars which not only secure the forms in spaced relationship, but which are longer than the conventional tie bars, having special insulation retention means attached thereto for retaining foam insulation layers or panels in position against the forms, adjacent the space to receive the poured concrete, so that the uncured concrete is formed directly against the insulation layer or layers. The insulation panels are retained in position by strips, preferably elongated, low-heat conductance, F-shaped strips as of polymer, these strips being held to the tie bars by transverse retainers. In one embodiment, these transverse retainers comprise insertable pins such as nails which fit into openings through the strips, and matching openings through the ties. In another embodiment, these transverse retainers take the form of a pair of ears integrally formed from the ties and extending into orifices in the strips. In another embodiment, these retainers comprise C-shaped spring clips which squeeze the polymer strips against opposite sides of the tie bar, and preferably engage a notch in the tie bar.

When the forms are ultimately removed, the strips remain on the finished wall with the insulation panels, serving as a base for attaching drywall screw fasteners, for example. The added components including strips and insulation do not interfere with the ability to knock the extended notched ends of the tie bars off the poured wall.

The novel method involves attachment of strips to the concrete forms to hold insulation layers, insertion of one or two layers of insulation as desired, preferably self supporting foam insulation panels, against the inside walls of the forms, with their edges retained in the strips and their inside face adjacent the space to receive the poured concrete, the strips holding the layers or panels of insulation while pouring the concrete into the space and against the insulation layer or layers. Subsequently the concrete is cured, and the forms removed while leaving the strips with the insulation. Eventually, the notched ends of the ties are broken off.

These and other objects, advantages and features of the invention will become apparent upon studying the following specification in conjunction with the drawings.

DESCRIPTION OF THE PREFERRED EMBODIMENT

Figure 1:
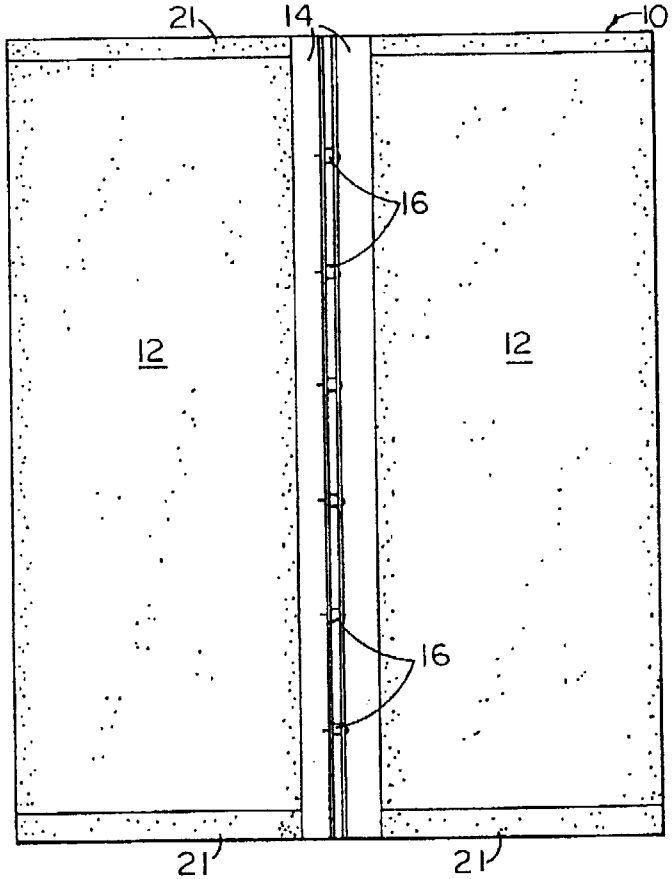
FIG. 1 is a side elevational view of a section of foam insulated concrete wall with strips in place.

Referring now specifically to the drawings, in FIG. 1 is depicted a portion of a poured concrete wall assembly 10 formed in accordance with this invention, the elevational view representing either the inside or outside wall portions, there being visible two adjacent insulation panels or layers 12 having their adjacent edges enveloped by and straddling a pair of F-shaped strips 14 positioned back-to-back. Between these strips and insulation panels 12, the ends of a plurality (here six) of elongated, transverse, metal form tie bars 16 extend through and from the poured concrete wall against which the insulation and strips are retained.

Figure 4:
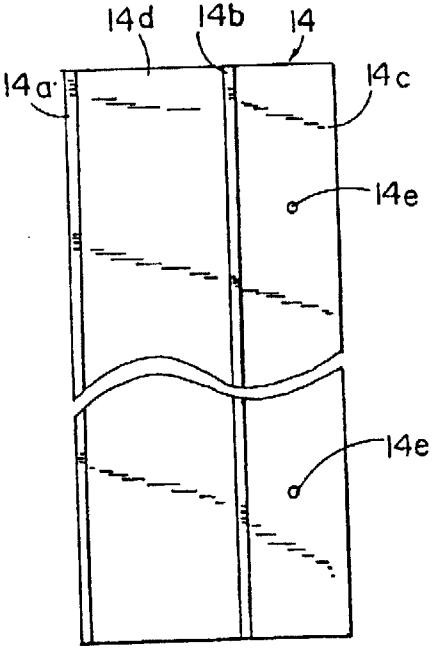
FIG. 4 is a fragmentary front elevational view of the strip in FIG. 3.
Figure 3:
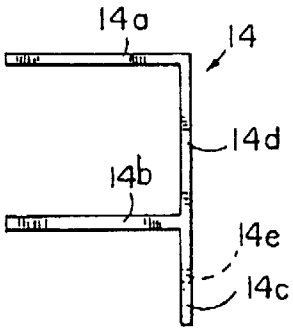
FIG. 3 is an end elevational view of the F-strip shown in FIGS. 1 and 2.

Each of elongated strips 14 is preferably of the F-shaped configuration depicted in FIGS. 3 and 4, having a U-shaped socket portion formed of a pair of parallel, spaced, extending legs 14*a* and 14*b* and a cross leg 14*d* therebetween, and including an elongated flange or leg 14*c* extending beyond this U-shaped configuration and in effect being an extension of cross leg 14*d*. Flange 14*c* is shown here to have one or more orifices or openings 14*e* therethrough for receipt of transverse fasteners such as pins 20 in the form of nails or the like, in a manner to be described more fully hereinafter. Openings 14*e* in the strip are spaced at vertical intervals corresponding to the vertical spacing of the tie bars 16 (sometimes called ties). These strips are formed of a low thermal conductivity material, preferably a polymeric material such as polyvinyl chloride, polyethylene, polypropylene, nylon, or any of several other available materials. The strips can be formed by a conventional extrusion process, and cut to selected length to match the height of the wall to be formed. The strips can also be easily cut on the job site to a particular length as desired.

The preferred strips are those of the F-shape as noted and shown, including the U-shaped channel or socket, and the extended flange. Conceivably other configurations could be employed. For example, U-shaped strips would serve to receive and retain the insulation panels. Attachment of the strips to the tie bars could be with fasteners extending through the cross leg of the U so as to tend to protrude somewhat into the channel and conceivably be undesirable. Attachment could also be by way of a double faced tape so as to adhere to the tie bars and/or to the forms.

Another alternative is to have the strips attached to the insulation prior to placement in the forms, and even by the insulation manufacturer. Such attachment could be by adhesive. Instead of the preferred strips, the insulation could be made with an adhesive edge, covered with a removable protective sheet, for adherence to the tie bars and/or the forms. The strips 14 could also be attached to the forms instead of, or in addition to, attachment to the tie bars.

Optionally, the top and bottom edges of the insulation panels can also be encompassed with strips, e.g., U-strips, as noted by phantom lines at 21 in FIG. 1, to cover them and also to provide receptors for dry wall screws.

These novel form tie bars 16 have some characteristics in common with conventional tie bars presently used in the trade, and some novel characteristics for functioning in this invention. One such type of novel tie bar is shown at FIGS. 5 and 6 with an alternative embodiment being shown in FIGS. 7 and 8.

Figure 6:
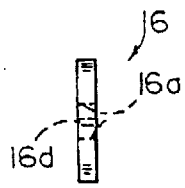
FIG. 6 is an end elevational view of the tie bar in FIG. 5.
Figure 5:
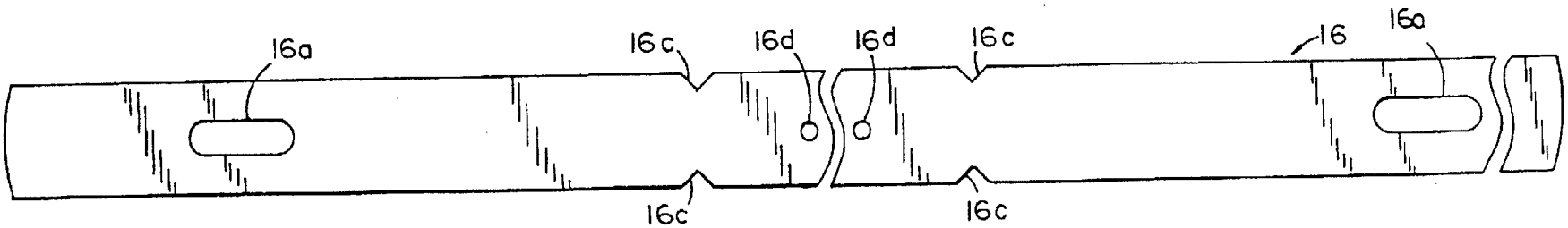
FIG. 5 is a side elevational view of one embodiment of the novel tie bar.

Referring first to the tie bar in FIGS. 5 and 6, it has a generally rectangular cross section comparable to that of tie bars presently used, includes a pair of laterally elongated, i.e., generally oval-shaped, slots 16*a* at opposite ends thereof for receiving fastener wedges 18 of conventional type, includes a central zone 16*b* between pairs of notches 16*c* astraddle this central zone 16*b*, and has a width between the two pairs of notches equal to the thickness of the concrete wall to be formed. This tie bar differs from a conventional tie bar in having a pair of through orifices 16*d* each located in center zone 16*b* a small distance from notches 16*c*. These orifices receive pins 20 (FIG. 2) as explained more fully hereinafter. These tie bars also differ from conventional tie bars in being of greater length, particularly between notches 16*c* and elongated openings 16*a*, to accommodate not only the thickness of conventional concrete forms 22, but also the thickness of the panels or layers of insulation 12. The particular length of the tie bar, and specifically the length of its center zone, depends on the wall thickness to be formed. The length of the tie bar zones between the notches 16*c* and slots 16*a* will depend on the thickness of the insulation layer to be employed.

Figure 2:
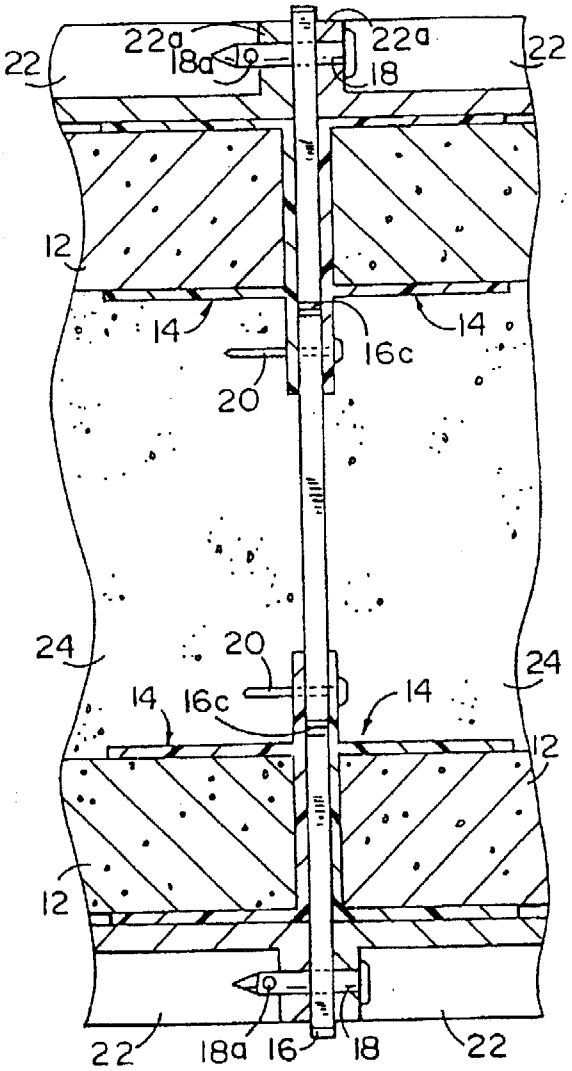
FIG. 2 is a top plan view of the wall in FIG. 1, but with the concrete forms still in place.

In the illustrative embodiment depicted in FIG. 2, insulation is provided on both the inside and outside wall surfaces of the poured concrete wall 24 being formed. This sectional view is taken at a location corresponding to one of the tie bars 16. As an alternative, insulation can, if desired, be applied to only one wall surface of the poured wall. Another variation possible is that of the insulation thickness. For example, this could be one inch, one and one-half inch, two inch, or otherwise. The socket size on the F-strip is selected to match the insulation thickness.

When practicing the method of this invention, the conventional forms 22 are first assembled in pairs in spaced parallel relationship to each other as depicted in FIG. 2, connected together with tie bars 16. Adjacent forms are tied together by extending the tapered wedge elements 18 through adjacent flanges 22*a* of the forms astraddle the ends of tie bars 16 in conventional manner. These wedge elements can be secured in position by nails or other pins extended through openings 18*a* secured in these wedge elements. Next the F-shaped strips 14 are placed vertically inside the forms, either on one or both inside surfaces of the forms, depending upon whether insulation is going to be provided on one wall surface or on both wall surfaces of the concrete wall being formed. These F-strips extend from the top to the bottom of the forms and are attached to tie bars 16 by inserting retention pins 20, e.g., nails, through openings 14*e* in the strips, and openings 16*d* in the tie bars 16. The appropriate number of insulation panels 12, e.g., two or three feet wide and the height of the forms, e.g., eight feet high, are placed with their vertical edges contained within the U-channel or socket of the F-strips, such that the outer surfaces of these insulation panels abut against the forms 22. These insulation panels are preferably formed of a foam-type, self-supporting polymer, e.g. , polyurethane, polystyrene, or other expanded polymers conventionally available in the trade. The thickness of the insulation layer is chosen for the particular R value desired, with the width of the U-channel of the F-strips being correspondingly selected. Uncured concrete is then poured into the space between the insulation panels on both sides, or between insulation panels on one side and forms on the other side. The weight of the uncured concrete causes it to press against the insulation panels for a bonding effect.

After the suitable curing period has been allowed to pass for the concrete to be firm and self supporting, forms 22 are removed in conventional fashion by removing wedge locks 18. This leaves the concrete wall 24 and the adjacent layers of insulation 12, as well as the strips 14, in position as an integral part of the wall. These strips are later useful for receiving dry wall fasteners, e.g., screws. The ends of tie bars 16*a* can be snapped off in suitable fashion as by pounding vertically with a hammer on the protruding portions, causing them to break at the notches 16*c* which are recessed behind the strips and insulation, i.e., at the concrete. The result is a well insulated wall not requiring any additional insulation to be sprayed on, glued on, or otherwise attached.

Figure 7:
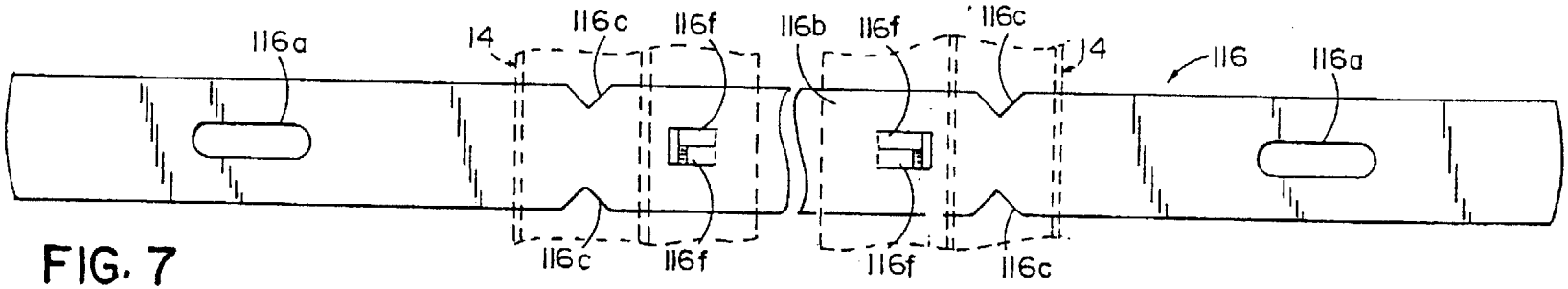
FIG. 7 is a top plan view of another embodiment of the novel tie bar.
Figure 8:
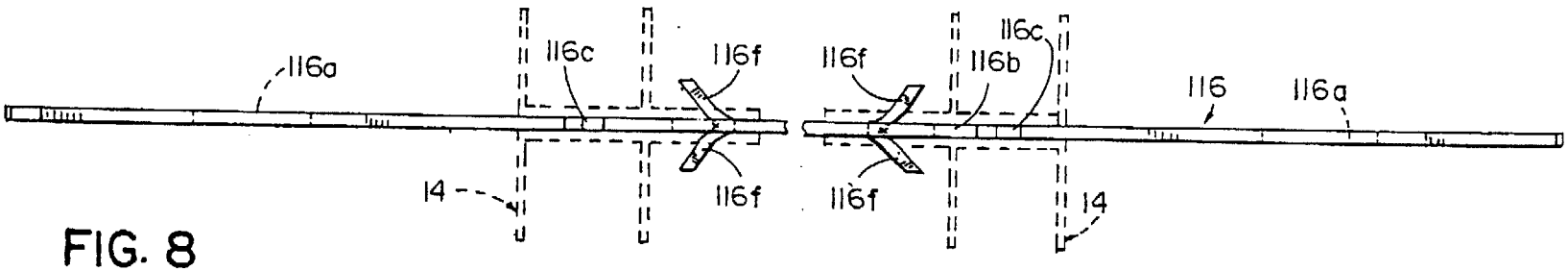
FIG. 8 is a front elevational view of the tie bar in FIG. 7.
Figure 12:
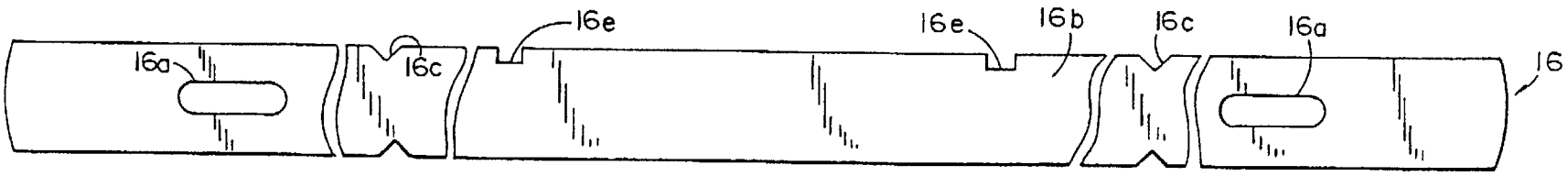
FIG. 12 is a side elevational view of a third embodiment of the novel form tie bars.

Referring to FIGS. 7 and 8, an alternative type of retention means is provided for securing the F-strips to the tie bars. Specifically, the tie bar 116 there depicted includes the openings 116*a* of conventional oval or elongated type adjacent the ends thereof, the conventional notches 116c to enable breaking off the protruding ends of the tie bars once the concrete has cured and the forms are removed. However, the tie bar also includes a pair of integral ears 116f stamped from and extending in opposite directions adjacent each end of the central zone 116b of the tie bars to serve as strip retaining means. These ears can fit into cooperative openings, i.e., retention means, such as those shown at 14e, or slightly larger openings, in the flanges 14c of strips 14 as shown in phantom in FIGS. 7 and 8, to retain these strips in position. In using this particular type of tie bar, no pins or nails 20 need be utilized as retaining means.

Figures 9, 10, 11, 13, 14:
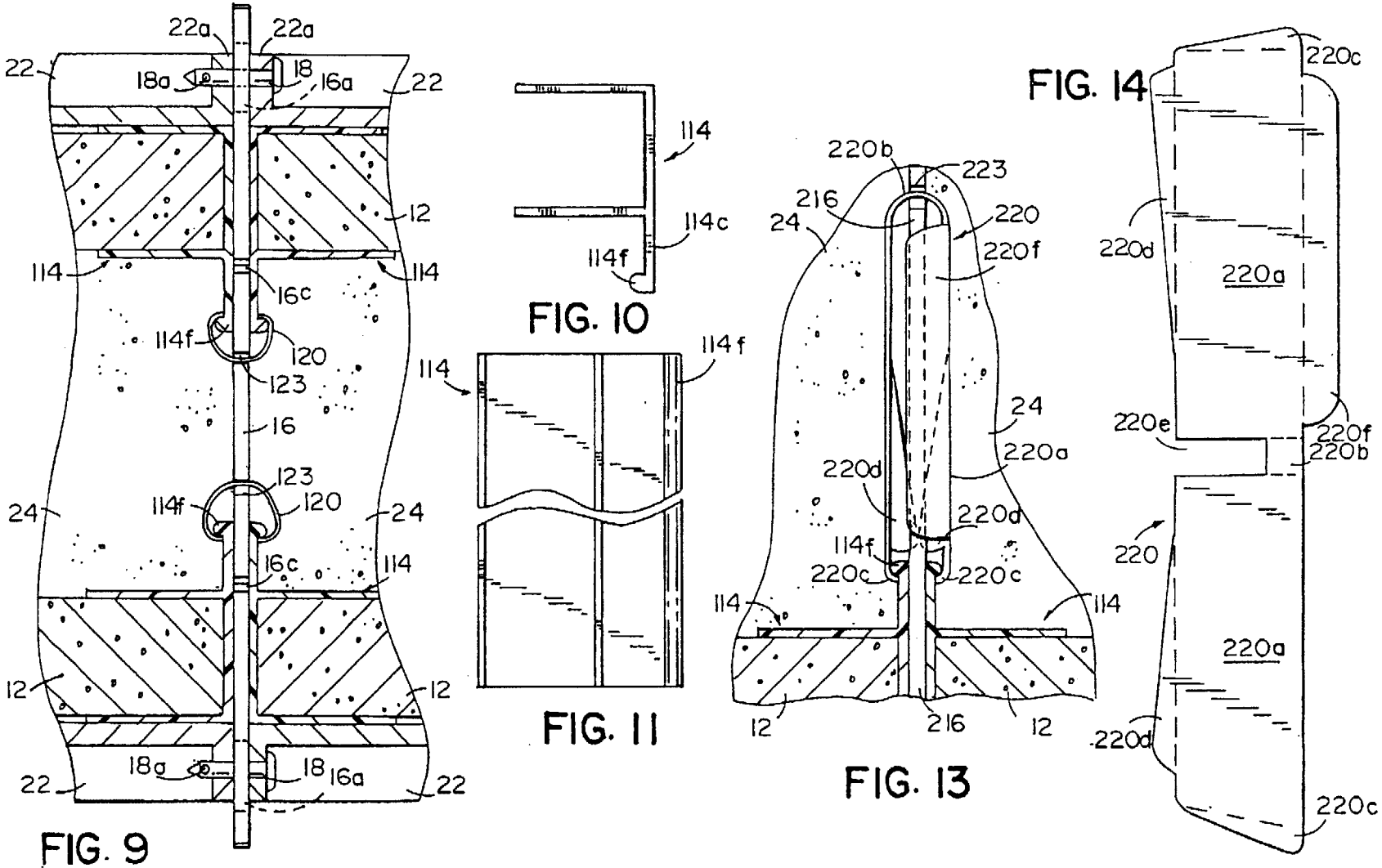
FIG. 9 is a top plan view of the wall in FIG. 1, showing a third embodiment of the tie bar and a strip retaining means.
FIG. 10 is an end elevational view of the polymeric F strip in FIG. 9.
FIG. 11 is a side elevational view of the polymeric F strip in FIG. 10.
FIG. 13 is a fragmentary, sectional view, on a horizontal plane, of an insulated wall assembly employing the F strip of FIGS. 10 and 11, the tie bar of FIG. 12, and a second embodiment of a retention clip which is shown in flat blank form in FIG. 14.
FIG. 14 is a plan view of the clip blank for the clip in FIG. 13.

Referring to FIG. 9, another alternative type of retainer is shown for retaining the strips to the tie bar, specifically C-shaped spring clips 120 of conventional spring steel. These have an at-rest spacing between the terminal ends thereof smaller than the combined thickness of the tie bar and a pair of the strips, so that when spread to encompass the tie bar and strips the clip will spring back to hold them together. Preferably notches 123 (see phantom lines in FIG. 5) are provided in the tie bars, inwardly of the break off notches 16c, to receive the edge of spring clip 120 at its bight for stabilizing the clip during pouring of the concrete.

The F strips 114 in FIG. 9 include the elongated flange or leg 114c, but in this embodiment the terminal ends of legs 114c include a protuberance 114f which extends the length of the extruded polymeric member (FIG. 11). The ends of the spring clip 120 extend around behind these protuberances 114f to prevent the clip from sliding off the ends of legs 114c.

In FIGS. 13 and 14 is shown a similar embodiment wherein the spring clips are of somewhat different configuration and have special added features. The clip is shown as a blank in FIG. 14, and as formed and attached in FIG. 13. The clip 220 shown in its final form in FIG. 13 cooperates with forms 22 in somewhat the same manner depicted in FIG. 9. The tie bars 216 have notches 223 to engage the bight of the clip comparable to those at 123 in FIG. 9, but spaced further toward the center of tie bar 216 because of the elongated nature of clip 220. Clip 220 has a pair of elongated, generally parallel legs 220a integrally joined at the U-shaped bight 220b, the free terminal ends 220c of the legs being curved toward each other to extend toward the F-shaped strips 114 on opposite sides of the tie 216, engaging behind the protuberances 114f on the terminal ends of the legs 114c of F strips 114. The ends 220c are each tapered to allow them to be snap fitted beyond protuberances 114f by engaging bight 220b against the top of tie bar 216 and pressing down on the clip. Extending inwardly toward tie bar 216 from the bottom edges of the two opposite legs 220a of clip 220 are a pair of integral, tapered abutment flanges 220d, the inwardmost edges of which springingly engage beneath the bottom edge of tie bar 216 when the clip is pressed into final position. Extending transversely from the top edge of one leg 220a is a flange 220f which abuts the top of tie 216. Flange 220f serves as a stop to prevent the clip from going too low, while flanges 200d serve as a stop to prevent the clip from rising.

This clip may be formed from the blank 220' shown in FIG. 14, this blank having like mirror image ends on opposite sides of the central connecting bridge that forms bight 220b and adjacent slot 220e. The two legs 220a of the clip blank are bent around the bridge 220b to be parallel to each other, the ends of these two legs being bent toward each other and the tapered flanges 220d being bent toward each other normal to the planes of legs 220a. Flange 220f is bent over the elongated upper edge of one leg 220a, generally parallel to flanges 220d.

When the clips 220, F strips 216, forms 22 and insulation panel or panels 12 are assembled, uncured, flowable concrete 24 is injected, usually poured, into the assembly in the manner described previously. Ultimately, after the concrete has cured, forms 22 are removed, leaving strips 114, clips 220 and the insulation panel or panels. Preferably the outer ends of the ties 216 are later broken off.

Variations of the structure illustrated herein as the preferred embodiment of the invention may be apparent to those in this field once they have studied the above description. Such variations to suit a particular type of installation are considered to be within the scope of the invention, which is intended to be limited only by the scope of the appended claims and the reasonably equivalent structures and methods to those defined therein.

The embodiments of the invention in which an exclusive property or privilege is claimed are defined as follows:

1. An insulated poured concrete wall structure comprising:

a concrete wall having opposite wall surfaces;

a plurality of vertically spaced tie bars extending through said concrete wall;

vertically elongated polymeric retaining strips on at least one of said wall surfaces, extending astraddle said plurality of vertically spaced tie bars, and having a leg embedded in said concrete wall;

insulation panels on at least one of said wall surfaces and having edges retained by said retaining strips;

said retaining strips being F-shaped so as to have U-shaped channels and an extending leg, said extending leg being said embedded leg, and said U-shaped channels receiving and retaining said insulation panel edges; and retainers between said vertically elongated strips and said plurality of tie bars and embedded in said concrete wall.

2. An insulated poured concrete wall structure comprising:

a concrete wall having opposite wall surfaces;

a plurality of tie bars extending through said concrete wall;

elongated retaining strips on at least one of said wall surfaces, astraddle said tie bars, and having a leg embedded in said concrete wall;

insulation panels on at least one of said wall surfaces and having edges retained by said retaining strips;

said retaining strips being F-shaped so as to have U-shaped channels and an extending leg, said extending leg being said embedded leg, and said U-shaped channels receiving and retaining said insulation panel edges;

retainers on said strips and tie bars and embedded in said concrete wall; and said retainers being spring clips.

3. The insulated poured concrete wall structure in claim 2 wherein said spring clips are C-shaped and extend around said extending legs of said retaining strips and said tie bars.

4. The insulated poured concrete wall structure in claim 3 wherein said extending legs have protrusions and said spring clips extend behind said protrusions.

* * * * *